US006098830A

United States Patent [19]

Jamieson

[11] Patent Number: 6,098,830

[45] Date of Patent: Aug. 8, 2000

[54] RESEALABLE FLIP-TOP BEVERAGE CAN LID

[76] Inventor: Michael Jamieson, 3473 W. Farrell Cir., Newberry Park, Calif. 91320

[21] Appl. No.: 09/167,656

[22] Filed: Oct. 5, 1998

Related U.S. Application Data

[60] Provisional application No. 60/061,658, Oct. 9, 1997.

[51] Int. Cl.[7] ..... B65D 17/32; A47G 19/22

[52] U.S. Cl. ..... 220/258; 220/269; 220/730; 220/906; 81/3.55

[58] Field of Search ..... 220/269, 258, 220/270, 255, 256, 259, 277, 278, 906, 716, 729, 730; 81/3.55, 3.47, 3.57, 3.09

[56] References Cited

U.S. PATENT DOCUMENTS

| | | | |
|---|---|---|---|
| 4,433,792 | 2/1984 | Mandel | 220/269 |
| 4,442,950 | 4/1984 | Wilson | 220/269 |
| 4,463,866 | 8/1984 | Mandel | 220/258 X |
| 4,717,039 | 1/1988 | Ayyoubi . | |
| 4,790,444 | 12/1988 | Terzi . | |
| 4,880,136 | 11/1989 | Englert . | |
| 4,930,654 | 6/1990 | Thibeault . | |
| 4,979,635 | 12/1990 | Levine | 220/258 X |
| 5,199,591 | 4/1993 | Thibeault . | |
| 5,285,924 | 2/1994 | Morris . | |
| 5,351,853 | 10/1994 | Shock . | |
| 5,353,942 | 10/1994 | Dominguez | 220/729 X |
| 5,555,993 | 9/1996 | Borkowski et al. | 220/269 |
| 5,785,199 | 7/1998 | Woidtke | 220/258 |
| 5,813,559 | 9/1998 | Cho | 220/258 |
| 5,911,794 | 6/1999 | Nordhoff | 81/3.55 |

FOREIGN PATENT DOCUMENTS

| | | | |
|---|---|---|---|
| 4035395 | 5/1992 | Germany | 220/269 |
| 2255081 | 10/1992 | United Kingdom | 220/269 |

*Primary Examiner*—Stephen K. Cronin
*Assistant Examiner*—Nathan Newhouse
*Attorney, Agent, or Firm*—Eric Karich

[57] ABSTRACT

A resealable flip-top beverage can lid has a lid having a rim disposed on the periphery thereof; a swinging seal positioned to seal an opening in the lid; and a tab rotatably attached to the lid with a rivet. The tab has a hole punching lip and an extended lifting section on opposite sides of the rivet. The extended lifting section extending at least to the rim and is shaped to cover and substantially seal the opening in the lid. While it is preferred that the seal be strong enough to maintain any carbonation within the beverage can, a weaker seal is also beneficial in excluding insects and preventing or limiting spills. The extended lifting section preferably further includes a rim locking section to locks onto the rim of the lid.

10 Claims, 5 Drawing Sheets

RESEALABLE FLIP-TOP BEVERAGE CAN LID

This application for a utility patent follows a previously filed provisional patent having the Ser. No. 60/061,658 and a filing date of Oct. 9, 1997.

BACKGROUND OF THE INVENTION

1. Field of the Invention

This invention is in the field of flip-top lids for cans of carbonated soda, more particularly a flip-top lid that is easier to open and resealable.

2. Description of Related Art

A traditional can for drinking carbonated cola includes a flip-top lid that can be opened easily but cannot be resealed. The can includes a lid with a rim and a lid scoring that defines a swinging seal. A tab attached to the lid with a rivet is designed to act like a lever to punch the swinging seal inwards and thereby form an opening with a perimeter for dispensing the liquid (not shown) contained in the can. The lid scoring only forms a weak section in the lid and it does not break the seal, thereby maintaining the carbonation of the liquid and preventing spillage. It only required a modest pressure on the tab, however, to punch the swinging seal inwards, forming the opening and allowing easy consumption of the liquid contained therein. To enable a user to lift the tab and obtain this lever action on the swinging seal, it is necessary for the user to get his finger under the tab. To facilitate this, the tab is generally folded so that it is raised slightly from the lid of the can. It is also necessary to carefully fold the tab into a complex configuration suitable for easy use because a flat tab would be very difficult to grasp and use. The disadvantages of this configuration are as follows: (1) the opening process is irreversible, so there is no convenient way to close or reseal the opening once made; (2) it is often difficult for the user to get his or her finger under the tab despite the careful design and folding of the tab; and (3) the manufacture of the tabs is much more difficult and expensive because of the need to carefully style and fold the tab, rather than use a simple stamping process.

Various devices have been created to improve the traditional flip-top can. Descriptions of these devices can be found in the following patents: Shock, U.S. Pat. No. 5,351,853, Morris, U.S. Pat. No. 5,285,924, Thibeault, U.S. Pat. No. 5,199,591 and U.S. Pat. No. 4,930,654, Ayyoubi, U.S. Pat. No. 4,717,039, and Terzi, U.S. Pat. No. 4,790,444. While these inventions allow the user to reseal their flip-top can, the inventions require the use of an additional element, generally made of plastic, that is attached to the traditional flip-top can. None of these inventions are simple, convenient, and cheap enough for widespread acceptance.

The prior art teaches a device to reseal a flip-top can. However, the prior art does not teach a device that is so simple and inexpensive that it can be integrated into the manufacturing of the flip-top can. The prior art does not teach a simple mechanical improvement that allows the flip-top can to be easier to open, resealable, as well as cheaper to manufacture. The present invention fulfills these needs and provides further related advantages as described in the following summary.

SUMMARY OF THE INVENTION

The present invention teaches certain benefits in construction and use which give rise to the objectives described below.

The present invention provides a resealable flip-top beverage can lid. The beverage can lid includes a lid having a rim disposed on the periphery thereof, a swinging seal positioned to seal an opening in the lid; and a tab rotatably attached to the lid with a rivet. The tab has a hole punching lip and an extended lifting section on opposite sides of the rivet. The extended lifting section extending at least to the rim and is shaped to cover and substantially seal the opening in the lid. While it is preferred that the seal be strong enough to maintain any carbonation within the beverage can, a weaker seal is also beneficial in excluding insects and preventing or limiting spills. The extended lifting section preferably further includes a rim locking section to locks onto the rim of the lid.

A primary objective of the present invention is to provide a resealable flip-top beverage can lid having advantages not taught by the prior art.

Another objective is to provide a new tab that is long enough to reach the edge of the can, preferably even overhanging the edge of the can. The length of the tab, especially when the tab actually overhangs the edge of the can, allows the user to grasp the end of the tab with his or her fingertips rather than sticking his or her finger under the tab and between the top of the can. This advantage is especially important to women who have long acrylic fingernails, and children whose fingers are not strong enough to operate the conventional tab. This also eliminates the need for special bending and folding of the tab, which was necessitated by the need to facilitate users getting their fingers under the tab in the first place. By extending the length of the tab, it becomes possible to manufacture the tab with a single and simple stamping process, greatly reducing the time and expense of tab manufacture. Furthermore, the length of the tab allows the use of a rim locking section that facilitates resealing the opening, as described below.

A further objective is to provide a new tab that is contoured to cover and reseal the opening which is made in the can. This element remains firmly in contact with the top of the can so that when it is in position it can cover and even reseal the opening in the lid of the can.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
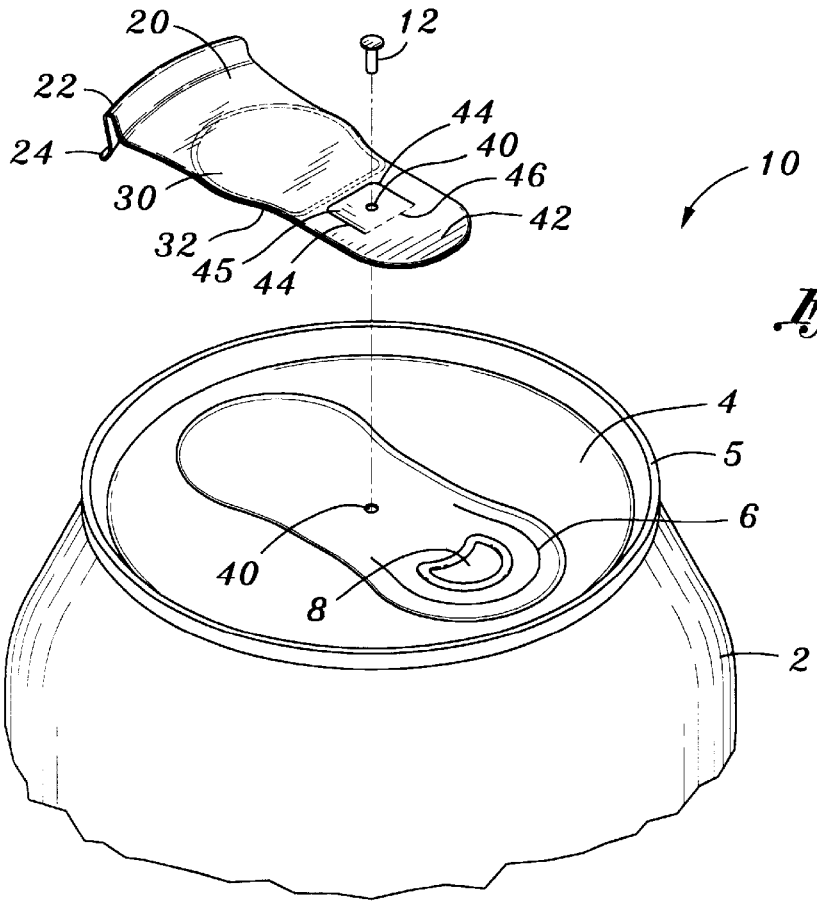
FIG. 1 is a exploded prospective view of the lid of a fragmented can with an improved tab having the structure of a first embodiment of the invention.
Figure 2:
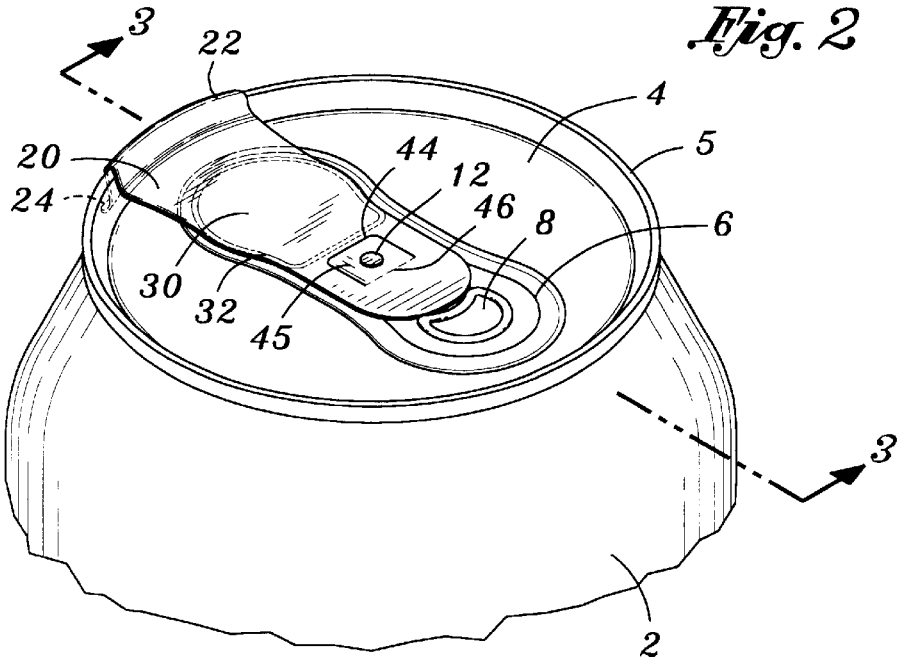
FIG. 2 is a prospective view of embodiment thereof, showing the improved tab in its initial position.

The above described drawing figures illustrate the invention, a resealable flip-top beverage can lid 1. The beverage can lid 1 includes a lid 4 having a rim 5 disposed on the periphery thereof; a swinging seal 8 positioned to seal an opening 13 in the lid 4; and a tab 10 rotatably attached to the lid 4 with a rivet 12. The tab 10 has a hole punching lip 42 and an extended lifting section 20 on opposite sides of the rivet 12. The extended lifting section 20 extends at least to the rim 5 and is shaped to cover and substantially seal the opening 13 in the lid 4. While it is preferred that the extended lifting section 20 form a seal that is strong enough to maintain any carbonation within the beverage can, a weaker seal is acceptable. Even a very weak seal would be beneficial in excluding insects and preventing or limiting spills.

The lid 4 of the invention fits onto a can 2, preferably a cylindrical tin can as used in the prior art. The lid 4 preferably includes a lid scoring 6 that defines the swinging seal 8. The tab 10 attached to the lid 4 with the rivet 12 is designed to act like a lever to punch the swinging seal 8 inwards and thereby form an opening 13 with a perimeter 13A for dispensing the liquid (not shown) contained in the can 2. The lid scoring 6 only forms a weak section in the lid 4 and it does not break the seal, thereby maintaining the carbonation of the liquid and preventing spillage. In its preferred embodiment, one section of the swinging seal 8 is not scored; therefore, when the swinging seal 8 is punched inwards by the tab 10, the swinging seal 8 does not break off but remains attached to the lid 4.

The invention differs from the prior art can lids in the shape and operation of the tab. The primary goal of the tab is to allow easy grasping of the tab, the ability to reseal the beverage can with the tab, and preferably the ability to lock the tab into a resealed position onto the rim of the lid. There are three preferred embodiments of this basic structure. Those skilled in the art may be able to devise somewhat different embodiments of this invention; however, structures that embody these few and simple elements should be considered equivalent to the three preferred embodiments.

First Embodiment

Figure 3:
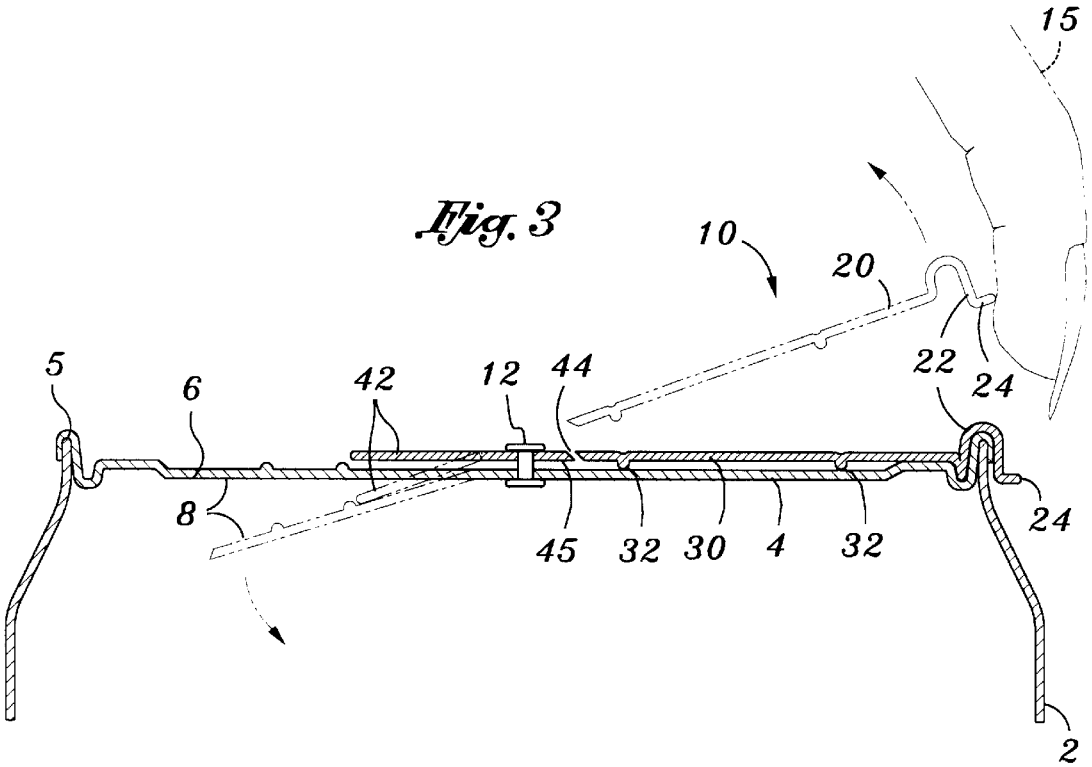
FIG. 3 is a side elevational view thereof taken along line 3—3 in FIG. 2, showing how the improved tab operates to open the can.
Figure 4:
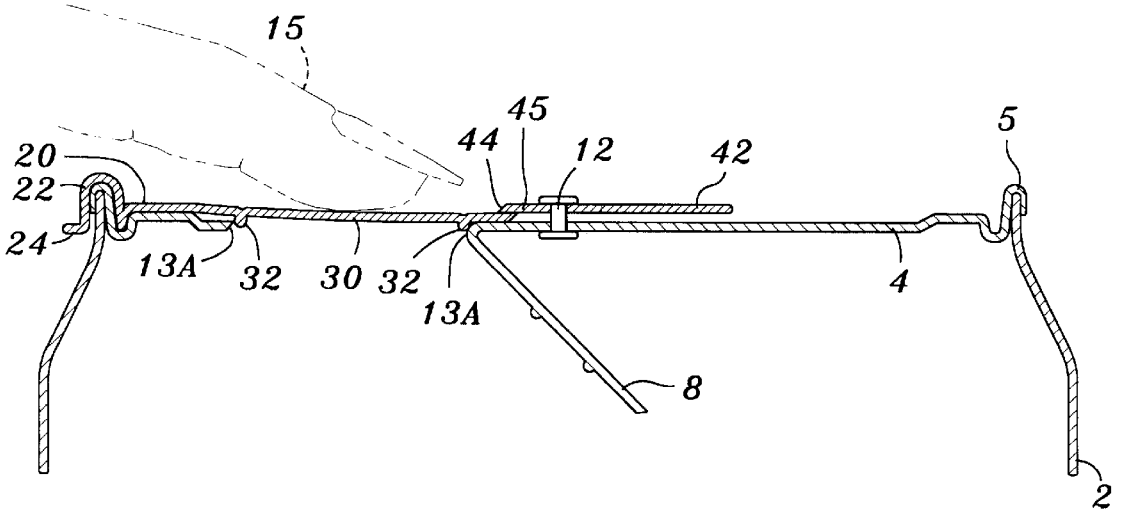
FIG. 4 is a side elevational view thereof, showing the tab resealing the can.

The first embodiment, shown in FIGS. 1–4, is preferred over the other embodiments. The first embodiment is characterized primarily by the fact that the tab 10 is made of one very simple sheet of aluminum. In this preferred embodiment, the tab 10 has an extended lifting section 20, preferably with a locking section 22 which overhangs and locks onto the rim 5 of the can 2. As shown in FIG. 4, the locking section 22 actually locks under the lid 4 to some extent, so the lock is secure. This locking section 22 can also include a lip 24 which allows easier lifting of the tab 10. While extending the extended lifting section 20 and adding a large lip 24 makes it easier to grasp the tab 10, this can also have the disadvantage of hindering shipping and packaging the can 2, so these factors must be balanced, and over extension is not desirable.

The tab 10 also has a contoured sealing section 30 integral with the extended lifting section 20. The contoured sealing section 30 is large enough to cover the opening 13 left when the swinging seal 8 is punched out. This contoured sealing section 30 preferably contains a stamped ridge 32, which not only adds strength to the element, but also seats against the perimeter 13A of the opening 13 facilitating the seal when the contoured sealing section 30 is used to reseal the lid 4. While this embodiment calls for the stamped ridge 32 to seal against the perimeter 13A, it is also possible for the seal to be made against a contour (not shown) in the surface of the lid 4 itself.

The tab finally has a rivet accepting hole 40 and a hole punching lip 42. The hole punching lip 42 is located opposite of the contoured sealing section 30 and the integral extended lifting section 20 with the rivet accepting hole 40 therebetween, forming a fulcrum. Around the rivet accepting hole 40 on the three sides opposite the hole punching lip 42 is a rivet scoring 44. The rivet scoring 44 can be formed by a complete cut, or by a partial scoring, and the cut is discussed in more detail below. On the fourth side, where there is no rivet scoring 44, is a crease 46. This crease 46 can be formed by pre-folding the aluminum, or by partially scoring the aluminum to form a preferred point of bending. Between the rivet accepting hole 40 and the rivet scoring 44 opposite the crease 46 is a rivet ridge 45. The rivet scoring 44 does not need to meet the exacting stress requirements of the lid scoring 6 because it does not impinge upon the seal of the can 2. A simple straight cut is acceptable; however, in its preferred embodiment, the scoring is made at a special angle to facilitate re-closing and resealing the can 2. The rivet scoring 44 should be made at an angle, preferably 45 degrees, as shown in FIGS. 3–4, such that the cut goes upwards as it moves towards the rivet. The function of this structure is described more fully below. The hole punching lip 42 is formed by the tab 10 on the side of the crease 46 opposite the rivet accepting hole 40.

In operation, the user first must open the can 2. To do so, he or she simply grasps the extended lifting section 20 or the locking section 22 and lifts up. It is also possible for the user to simply push up on the lip 24 with the tip of his or her finger 15. The rivet scoring 44 allows the extended lifting section 20 and the contoured sealing section 30 to lift easily upwards, hinging at the crease 46. The 45 degree angle of the rivet scoring 44 allows easy lifting at this point. This action causes the rivet to act as a lever, depressing the hole punching lip 42, which presses into the swinging seal 8 and breaking the lid scoring 6, forming a opening 13.

Once the user is finished drinking, this invention allows him to close and reseal the can 2. The tab 10 is rotated 180 degrees so that the contoured sealing section 30 is over the opening 13. The stamped ridge 32 seats against the perimeter 13A of the opening 13 facilitating a seal. The extended lifting section 20 is then pressed downwards and the locking section 22 is locked onto the rim 5 of the can 2. For an additional seal, the contoured sealing section 30 is depressed directly into the opening 13 so that the contoured sealing section 30 snaps beneath the rivet ridge 45. The angle at which the rivet scoring 44 was made serves to seal the contoured sealing section 30 over the opening 13.

Second Embodiment

Figure 5:
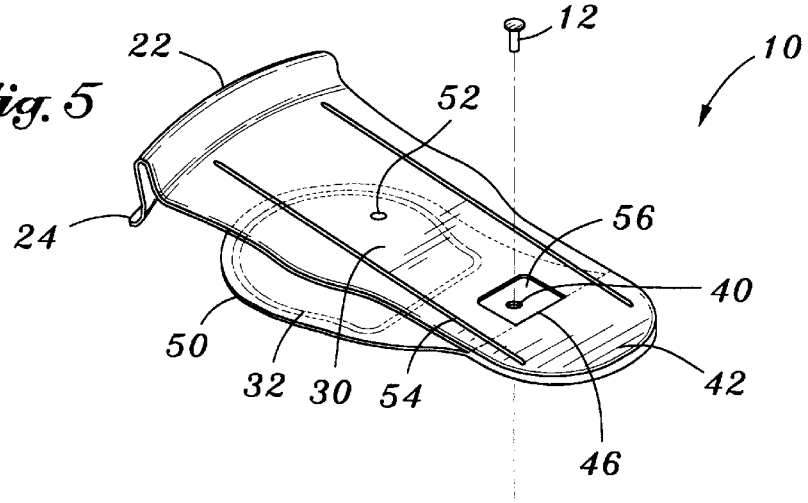
FIG. 5 is an exploded prospective view of a second embodiment of the improved tab.
Figure 6:
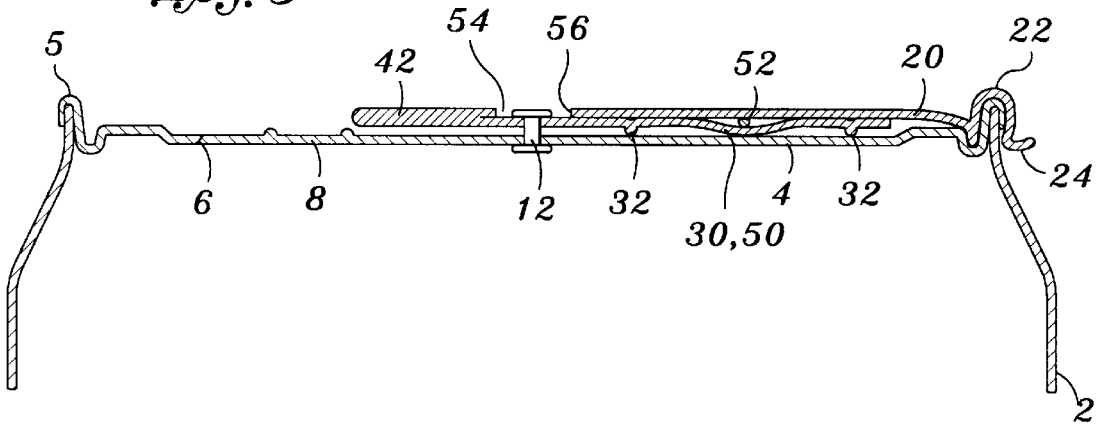
FIG. 6 is a side elevational view of the second embodiment of the improved tab as it is fastened to the can.
Figure 7:
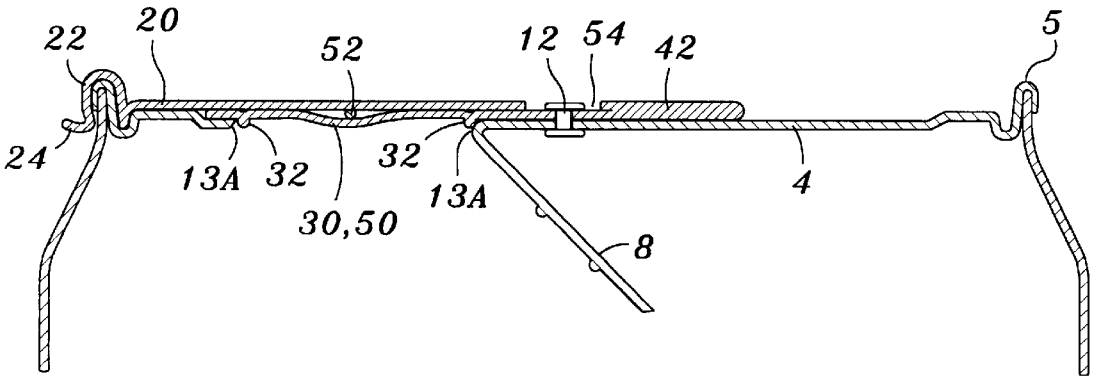
FIG. 7 is a side elevational view thereof, showing the tab resealing the can.
Figure 8:
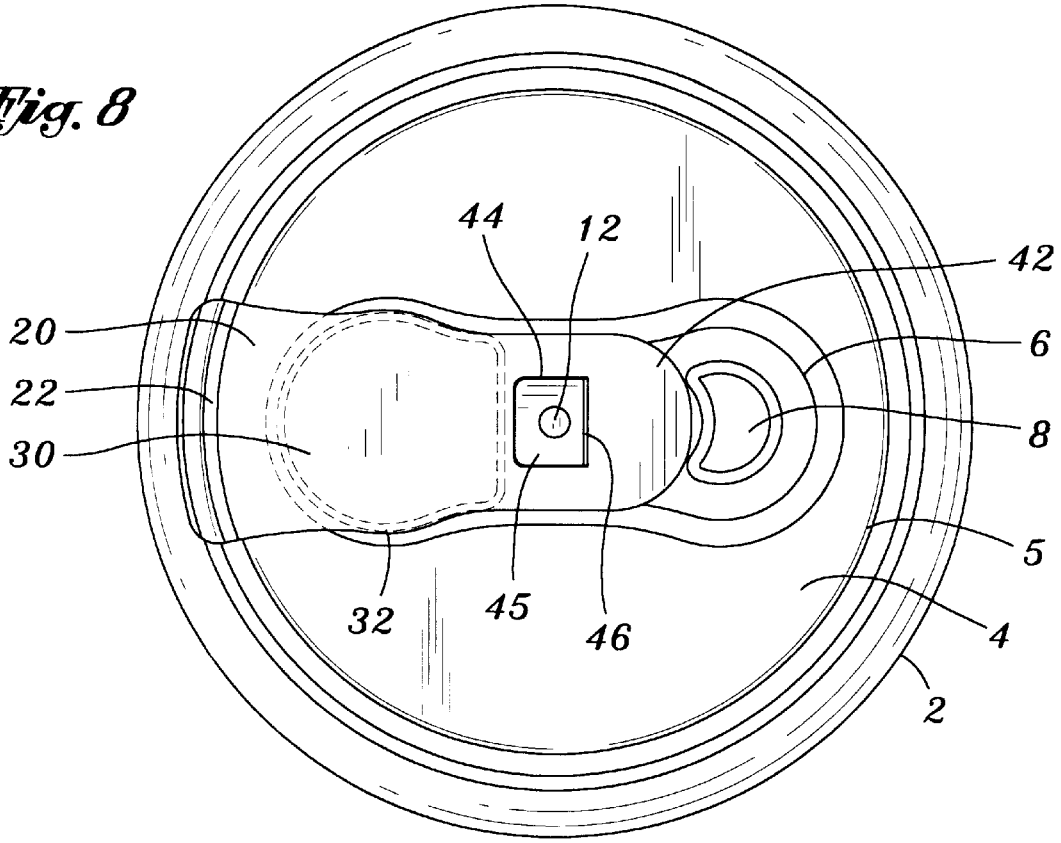
FIG. 8 is a top plan view of a can showing the improved tab in an initial position.
Figure 9:
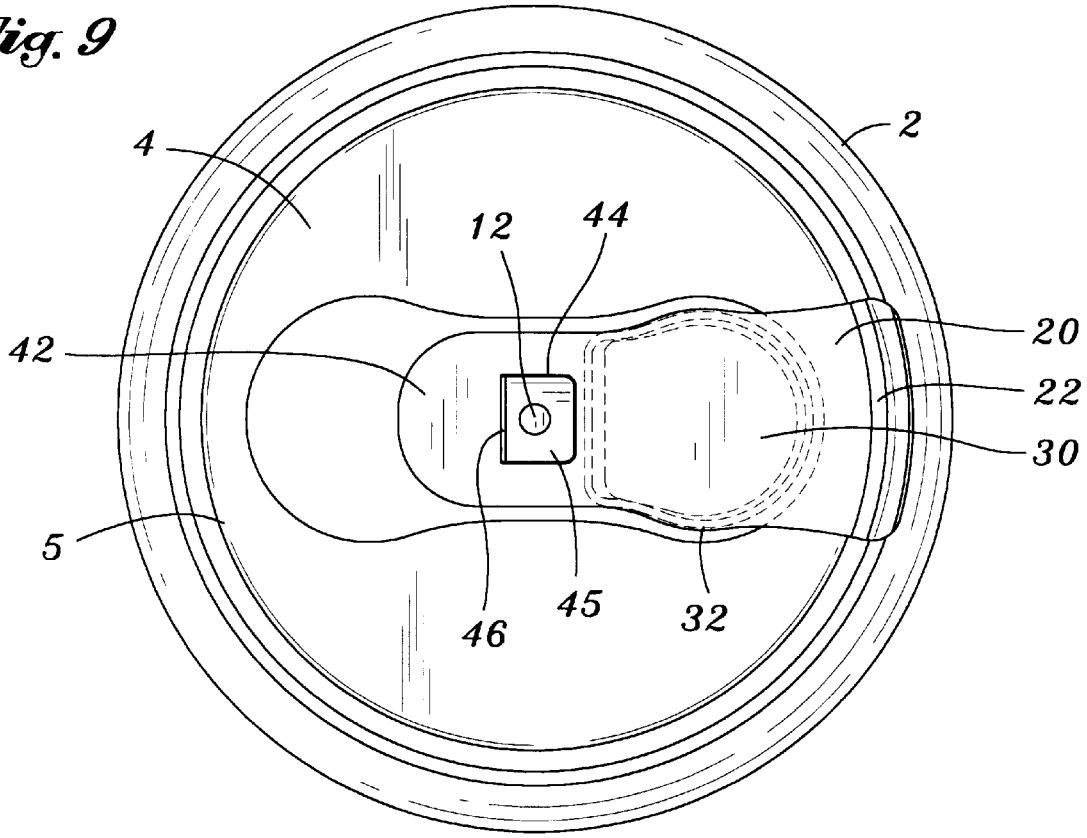
FIG. 9 is a top plan view of a can showing the improved tab rotated to a resealing position.

The second embodiment, shown in FIGS. 5–7, is characterized by the presence of two sheets (or one folded sheet) of aluminum rather than just one. In addition to the regular extended lifting section 20 as in the first embodiment, this invention has a lower tongue portion 50 which replaces the contoured sealing section 30 of the first embodiment.

In one version, the extended lifting section 20 is similar to the first embodiment, having a rivet accepting hole 40, a hole punching lip 42, rivet scoring 44, and a crease 46, as described above, forming a fulcrum. The lower tongue portion 50 is contoured to cover and seal the opening 13 made by the swinging seal 8, as described above. This lower tongue portion 50 has a rivet accepting hole 40 like the normal tab 10; however, there is no rivet scoring 44 or rivet ridge 45 in the lower tongue portion 50. The absence of any holes in the lower tongue portion 50 allows for an excellent seal without relying on any special angles to the rivet scoring 44. Also, since the lower tongue portion 50 is never bent upwards to open the can 2, it can remain tightly pressed against the lid 4 of the can 2 and thus form a better seal. In an alternative embodiment, the lower tongue portion 50 contains a rivet accepting hole 40 and the extended lifting section 20 has a hole (not shown) which is large enough for the entire rivet 12 to fit through. The extended lifting section 20 is attached to the lower tongue portion 50, thus forming the required fulcrum.

In a second embodiment, as shown in FIG. 5, there is no rivet scoring 44. The lower tongue portion 50 has a rivet accepting hole 40. The hole punching lip 42 is formed by fusing part of the lower tongue portion 50 with part of the extended lifting section 20 up to the vicinity of the rivet accepting hole 40. A lower crease 54 allows the lower tongue portion 50 to bend and form the proper fulcrum. To facilitate the riveting process during manufacture, a hole which is larger than the rivet 56 can be cut in the extended lifting section 20 so the rivet 12 can be inserted after the tab 10 has been folded. This embodiment is preferred because manufacturing the tab 10 is easy and the seal is better.

In both embodiments, the extended lifting section 20 is preferably folded or stamped with appropriate ridges to give the element strength, and the lower tongue portion 50 contains the stamped ridge 32 which fits within the perimeter 13A of the opening 13—or some other contour (not shown) on the face of the lid 4. As with the first embodiment, this stamped ridge 32 facilitates a good seal. To further facilitate the seal, the second embodiment also contains another feature. The extended lifting section 20 contains a bump 52 on its lower surface. When the extended lifting section 20 is pressed downward to the lid 4 of the can 2 and the locking section 22 snaps onto the rim 5 of the can 2, this bump 52 presses downward against the lower tongue portion 50 further strengthening the seal.

To facilitate manufacture, the second embodiment is preferably made of one sheet of aluminum and folded at the rivet ridge 45. There is preferably a lower crease 54 in the lower tongue portion 50 which compliments the crease 46 in the extended lifting section 20, facilitating lifting the extended lifting section 20 to open the can 2.

In both embodiments it is possible to further add to the sealing capabilities of the invention by adding a thin layer (not shown) of a texturing or rubber-like material to the underside of the contoured sealing section 30 or the lower tongue portion 50. Such layer must be safe for consumer products, durable, nontoxic, and easy to apply in manufacture. The material should also be designed to not interfere with the recycle of the cans 2.

Third Embodiment

Figure 10:
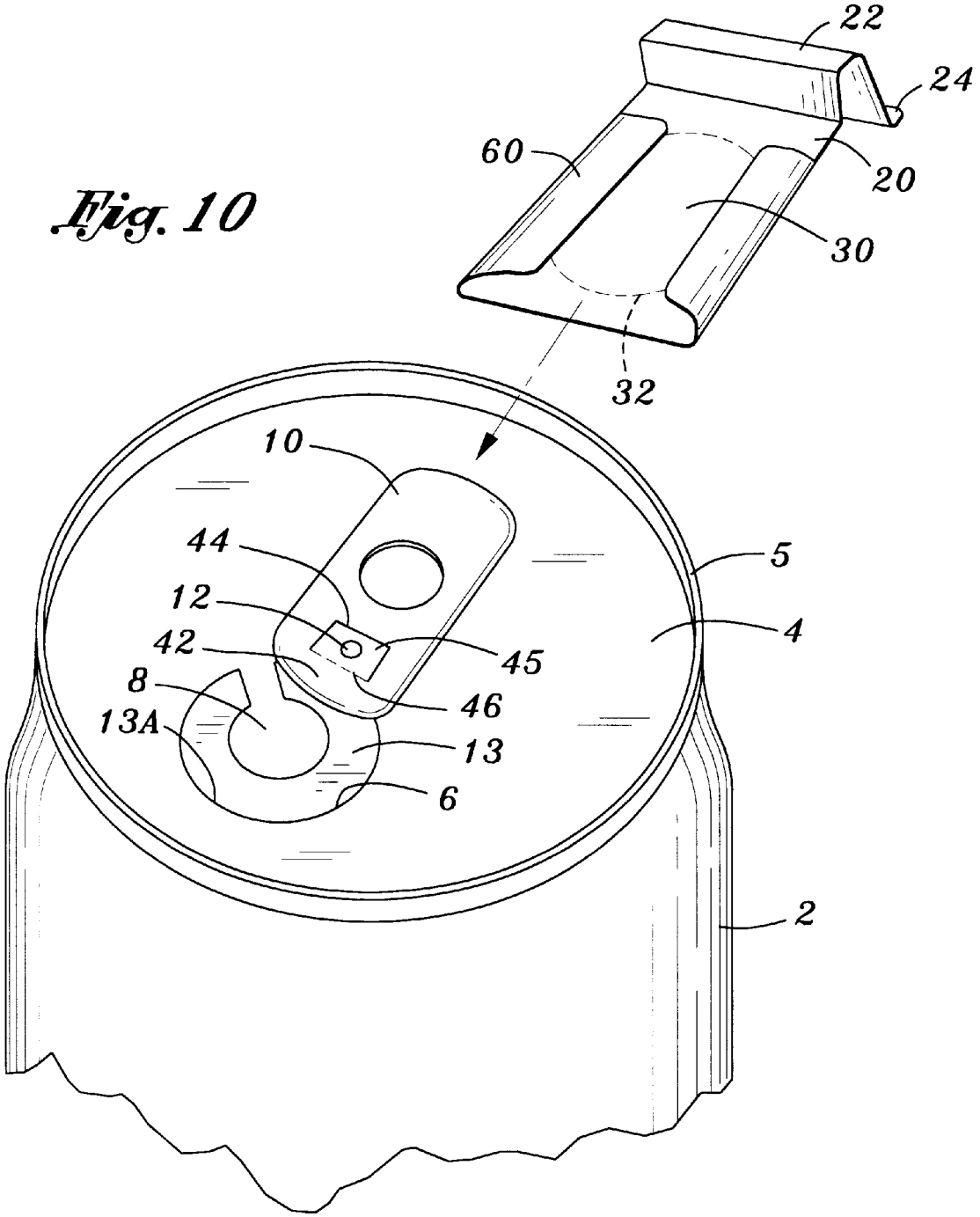
FIG. 10 is a perspective view of a third embodiment of the improved tab.

The third embodiment, shown in FIG. 10, includes a separate tab extension sleeve 60, preferably made of plastic, that can be added to a prior art can. While the previous embodiments requires a change in the process of manufacturing the cans, this invention is purchased by consumers for their attachment to the prior art cans that they purchase.

The sleeve 60 has two locking arms contoured to fit around the tab 10 of a prior art can 2. The sleeve 60 has an extended lifting section 20, a locking section 22, and a contoured sealing section 30 having a stamped ridge 32 as described above. First, the sleeve 60 is slipped onto the tab 10 and the extended lifting section 20 can be used to easily open the can 2 despite having long finger nails. The locking section 22 can then be snapped onto the rim 5 to hold the invention on the can 2. When you want to seal the can 2, the extended lifting section 20 can be used to turn the tab 10 180 degrees so that the contoured sealing section 30 fits over the opening 13 in the lid 4. Finally, the locking section 22 snaps onto the rim 5 forming a seal as described above.

This invention preferably contains all of the contours and snapping mechanisms (including the ability to snap under the rivet ridge 45) described in the first two embodiments to form a good seal. The third embodiment can also include a lower tongue portion 50 as described in the second embodiment if this extra sealing protection is found necessary, but this alternative is not preferred.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A resealable flip-top beverage can lid comprising:

a lid having a rim disposed on the periphery thereof;

a swinging seal attached to the lid and movable from a first position in which the swinging seal seals an opening in the lid, to a second position in which the swinging seal does not seal the opening;

a tab attached to the lid with a rivet that allows rotation of the tab from an initial position to a resealing position, the tab having a hole punching lip and an extended lifting section on opposite sides of the rivet;

the tab having a rivet scoring between the rivet and the extended lifting section, the rivet scoring being cut to allow the extended lifting section to be lifted, causing the hole punching lip to lever the swinging seal from the first position to the second position, thereby opening the can;

the extended lifting section extending at least to the rim and having a contoured sealing section that is shaped to seal the opening in the lid when the tab is rotated about the rivet from the initial position to the resealing position; and the tab having a rivet ridge between the rivet and the contoured sealing section, the contoured sealing section being shaped to snap under the rivet ridge when the tab is in the resealing position, thereby sealing the opening in the lid.

2. The beverage can lid of claim 1 wherein the rivet scoring is cut at an angle that allows the extended lifting section to be raised without interference, yet functions to further lock once the contoured sealing section has been snapped under the rivet ridge.

3. A resealable flip-top beverage can lid comprising:

a lid having a rim disposed on the periphery thereof;

a swinging seal attached to the lid and movable from a first position in which the swinging seal seals an opening in the lid, to a second position in which the swinging seal does not seal the opening;

a tab attached to the lid with a rivet that allows rotation of the tab from an initial position to a resealing position, the tab having a hole punching lip, an extended lifting section, and a lower tongue portion;

the tab having a rivet scoring between the rivet and the extended lifting section, the rivet scoring being cut to allow the extended lifting section to be lifted, causing the hole punching lip to lever the swinging seal from the first position to the second position, thereby opening the can, the extended lifeing section extends beyond the lower tongue portion; and the lower tongue portion having a contoured sealing section that is shaped to completely seal the opening in the lid when the tab is rotated about the rivet from the initial position to the resealing position.

4. The beverage can lid of claim 3 wherein the extended lifting section extends to lock onto the rim.

5. The beverage can lid of claim 4 wherein the tab further includes a bump that functions to depress the lower tongue portion when the extended lifting section is locked onto the rim.

6. The beverage can lid of claim 4 wherein the lower tongue portion includes a stamped ridge that interacts with a perimeter of the opening to facilitate a good seal.

7. A resealable flip-top beverage can lid comprising:

a lid having a rim disposed on the periphery thereof;

a swinging seal attached to the lid and movable from a first position in which the swinging seal seals an opening in the lid, to a second position in which the swinging seal does not seal the opening;

a tab attached to the lid with a rivet that allows rotation of the tab from an initial position to a resealing position, the tab having a hole punching lip;

the tab having a rivet scoring adjacent the rivet, the rivet scoring being cut to allow the tab to be lifted, causing the hole punching lip to lever the swinging seal from the first position to the second position, thereby opening the can; and a tab extension sleeve that engages the tab, the tab extension sleeve having a contoured sealing section that is shaped to completely seal the opening in the lid when the tab is rotated about the rivet from the initial position to the resealing position, the tab extension sleeve further having an extended lifting section that facilitates lifting the tab to lever the hole punching lip.

8. The beverage can lid of claim 7 wherein the contoured sealing section includes a stamped ridge that interacts with a perimeter of the opening to facilitate a good seal.

9. The beverage can lid of claim 8 wherein the tab extension sleeve includes two locking arms contoured to fit around the tab, thereby allowing the tab extension sleeve to be slipped onto the tab.

10. The beverage can lid of claim 7 wherein the extended lifting section extends to lock onto the rim.

* * * * *